US008743103B2

(12) United States Patent
Lin et al.

(10) Patent No.: US 8,743,103 B2
(45) Date of Patent: Jun. 3, 2014

(54) SOURCE DRIVER UTILIZING MULTIPLEXING DEVICE AND SWITCHING DEVICE

(75) Inventors: Yung-Hsu Lin, Hsin-Chu (TW); Chun-Fan Chung, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 363 days.

(21) Appl. No.: 13/206,527

(22) Filed: Aug. 10, 2011

(65) Prior Publication Data

US 2012/0169689 A1 Jul. 5, 2012

(30) Foreign Application Priority Data

Dec. 31, 2010 (TW) ..... 099147204 A

(51) Int. Cl.
*G09G 3/36* (2006.01)

(52) U.S. Cl.
USPC ..... 345/209; 345/96

(58) Field of Classification Search
USPC ..... 345/209, 96
See application file for complete search history.

(56) References Cited

U.S. PATENT DOCUMENTS 6,373,459 B1 4/2002 Jeong
7,030,844 B2 4/2006 Kang
7,292,217 B2 11/2007 Tseng
2003/0090451 A1* 5/2003 Ahn ..... 345/96
2003/0132907 A1* 7/2003 Lee et al. ..... 345/98
2004/0104873 A1* 6/2004 Kang et al. ..... 345/87
2004/0104880 A1* 6/2004 Kang et al. ..... 345/94
2004/0125067 A1* 7/2004 Kim et al. ..... 345/98
2006/0028426 A1 2/2006 Hiratsuka
2006/0245591 A1* 11/2006 Choi et al. ..... 380/209
2007/0013639 A1 1/2007 Lin
2007/0268233 A1* 11/2007 Hashimoto et al. ..... 345/100
2011/0050680 A1* 3/2011 Chung et al. ..... 345/214
2012/0086677 A1* 4/2012 Lin et al. ..... 345/204

FOREIGN PATENT DOCUMENTS

CN 1731499 A 2/2006

* cited by examiner

*Primary Examiner* — Claire X Pappas
*Assistant Examiner* — Robert Stone
(74) *Attorney, Agent, or Firm* — Winston Hsu; Scott Margo

(57) ABSTRACT

In accordance with revealed embodiments of the present invention, a source driver is provided, which is capable of providing a variety of polarity inversion patterns of source driving signals. Additionally, due to properly utilizing a multiplexing device and a switching device, hardware architecture of the inventive source driver is no more complicated than that of the conventional source driver. As a result, the present invention provides a source driver having the greater performance than the conventional source driver without increasing hardware cost and circuitry complexity.

4 Claims, 9 Drawing Sheets

SOURCE DRIVER UTILIZING MULTIPLEXING DEVICE AND SWITCHING DEVICE

BACKGROUND

1. Technical Field

The present invention relates to a liquid crystal display technique, and more particularly, to a source driver capable of providing a variety of signal polarity converting patterns.

2. Description of the Prior Art

Liquid crystal display (LCD) has characteristics such as a planar screen, a slim body, and low power consumption, so it is favored in the market and becomes a mainstream display technique. The operation principle of the LCD is mainly to apply an external electric field to two poles of a liquid crystal (LC) cell. This causes the LC cell to be rotated to different degrees, thereby controlling amount of light transmission. Finally, since different light transmission amounts may generate different grey-level effects, the image is therefore displayed by mixing different primary colors of light. However, if an electric field of a specific direction is continuously imposed upon the LC cell for a long time, it will damage the structure of the LC cell. So, in an actual implementation of driving the LC cell, alternatively switching between different polarities of the driving voltage during a certain period is utilized, which is also called polarity inversion. In order to achieve the driving effect of the polarity inversion, the circuit structure of the source driver which is utilized for generating the driving voltage is specially designed. Please refer to the following description for details of the circuit structure of the source driver with polarity inversion functionality.

Please refer to FIG. 1, which is a simplified function block diagram of a conventional source driver. As shown in the figure, the source driver 10 includes shift registers (SRs) 11_1-11_2, primary latching circuits (PRI_LATCHs) 12_1-12_2, secondary latching circuits (SEC_LATCHs) 13_1-13_2, level shifting circuits (LS_CKTs) 14_1-14_2, digital-to-analog converting circuits (DAC_CKTs) 15_1-15_2, output buffer circuits (OUT_BUFs) 16_1-16_2, and output circuits (OUT_CKTs) 17_1-17_2. A combination of the shift register (SR) 11_1, the primary latching circuit (PRI_LATCH) 12_1, the secondary latching circuit (SEC_LATCH) 13_1, the level shifting circuit (LS_CKT) 14_1, the digital-to-analog converting circuit (DAC_CKT) 15_1, the output buffer circuit (OUT_BUF) 16_1 and the output circuit (OUT_CKT) 17_1 forms a so-called signal channel 10A. The source driving signal which is generated via the signal channel will be transmitted to a pixel via a signal line. Similarly, a combination of other circuits forms another signal channel 10B. As to each signal channel, the digital-to-analog converting circuit (DAC_CKT) 15_1 or 15_2 may be controlled by a polarity control signal POL to change polarities of output signals of the respective signal channels. For example, if an analog voltage generated from the digital-to-analog converting circuit (DAC_CKT) by processing the digital input pixel data is 20V, the digital-to-analog converting circuit (DAC_CKT) 15_1/15_2 refers to the polarity control signal POL to output +20V or −20V to the output circuit (OUT_CKT) 17_1/17_2 for driving the pixel. However, if it is desired to support a positive voltage output as well as a negative voltage output, the circuit structure of the digital-to-analog converting circuit (DAC_CKT) 15_1/15-2 is more complicated than that of the digital-to-analog converting circuits (DAC_CKTs) which only output voltages of a single polarity. As a result, the whole circuit area of the source driver 10 is increased accordingly.

Therefore, there is an improved structure of a source driver according to the prior art. Please refer to FIG. 2, which is a function block diagram of an improved source driver. As shown in the figure, the source driver 20 includes shift registers (SRs) 21_1-21_2, primary latching circuits (PRI_LATCHs) 22_1-22_2, secondary latching circuits (SEC_LATCHs) 23_1-23_2, level shifting circuits (LS_CKTs) 24_1-24_2, digital-to-analog converting circuits (DAC_CKTs) 25_1-25_2, output buffer circuits (OUT_BUFs) 26_1-26_2, and output circuits (OUT_CKTs) 27_1-27_2. Each of the digital-to-analog converting circuits (DAC_CKTs) 25_1-25_2 in the signal channels 20A and 20B may only output voltages of a single polarity (i.e., either positive voltages or negative voltages). With the assistance of the switching devices 2A and 2B, the same objective of making the source driver 20 alternately change the signal polarities of the source driving signals is achieved. However, this structure only switches signal polarities of driving signals output by adjacent signal channels 20A and 20B. Therefore, the signal polarity inversion patterns finally achieved are limited. Besides, the improved source driver 20 has poorer variety of signal polarity inversion patterns than the traditional source driver 10. It is because the source driver 10 is capable of inverting polarities of signals generated from signal channels freely; however, the source driver 20 has to control the switching of signal routes of adjacent signal channels for achieving the signal polarity inversion effect. Therefore, the source driver 20 may only output a driving signal sequence with a regular polarity pattern of "positive, negative, positive, negative, . . . " or "negative, positive, negative, positive, . . . ", and fails to provide a driving signal sequence with any further polarity pattern. Briefly summarized, the conventional source driver structure still has room for improvement.

SUMMARY

Therefore, one of the objectives of the present invention is to provide a source driver which properly utilizes a multiplexing device and a switching device to establish signal transmitting routes between different signal channels. With the assistance of the multiplexing device and the switching device, the source driver of the present invention may achieve the effect of signal polarity inversion by using a digital-to-analog converting circuit (DAC_CKT) that may only output signals with a single signal polarity. Besides, compared to the conventional design, the multiplexing device and the switching device of the present invention simultaneously control signal transmitting routes of more signal channels, therefore providing more polarity inversion patterns of the driving signals.

An exemplary embodiment of the present invention provides a source driver, including: N primary latching circuits, a multiplexing device, N digital-to-analog converting circuits, a switching device and N output circuits. The N primary latching circuits (PRI_LATCHs) are utilized for respectively receiving N pixel data. The multiplexing device is coupled to the N primary latching circuits, and used for controlling signal transmitting routes of the N primary latching circuits. The N digital-to-analog converting circuits (DAC_CKTs) respectively have positive or negative signal outputs, and each digital-to-analog converting circuit (DAC_CKT) has a signal output polarity different from a signal output polarity of an adjacent digital-to-analog converting circuit. The N digital-to-analog converting circuits (DAC_CKTs) respectively generate N driving voltage signals according to the N pixel data. The switching device is coupled to the N digital-to-analog converting circuits, and used for controlling signal transmitting routes of the N digital-to-analog converting circuits. The N output circuits (OUT_CKTs) are utilized for receiving the N driving voltage signals, and outputting N source driving signals to N pixels, successively. The multiplexing device and the switching device alternatively switch polarities of a plurality of specific source driving signals respectively output by a plurality of adjacent output circuits (OUT_CKTs) within the N output circuits (OUT_CKTs) according to a polarity switching signal, respectively. While the polarities of the specific source driving signals are positive, negative, negative and positive during a first period, respectively, and the polarities of the specific source driving signals are negative, positive, positive and negative during a second period, respectively.

Preferably, during the first period, the multiplexing device and the switching device establish following signal transmitting routes: a signal transmitting route between a first primary latching circuit (PRI_LATCH) and a first digital-to-analog converting circuit, a signal transmitting route between a second primary latching circuit (PRI_LATCH) and a second digital-to-analog converting circuit, a signal transmitting route between a third primary latching circuit (PRI_LATCH) and a fourth digital-to-analog converting circuit, and a signal transmitting route between a fourth primary latching circuit (PRI_LATCH) and a third digital-to-analog converting circuit. Besides, the switching device establishes following signal transmitting routes: a signal transmitting route between the first digital-to-analog converting circuit (DAC_CKT) and the first output circuit, a signal transmitting route between the second digital-to-analog converting circuit (DAC_CKT) and the second output circuit, a signal transmitting route between the third digital-to-analog converting circuit (DAC_CKT) and the fourth output circuit, and a signal transmitting route between the fourth digital-to-analog converting circuit (DAC_CKT) and the third output circuit. The first primary latching circuit (PRI_LATCH) to the fourth primary latching circuit, the first digital-to-analog converting circuit (DAC_CKT) to the fourth digital-to-analog converting circuit (DAC_CKT) and the first output circuit (OUT_CKT) to the fourth output circuit (OUT_CKT) are respective adjacent to one another, and the first output circuit (OUT_CKT) to the fourth output circuit (OUT_CKT) respectively output the specific source driving signals.

Preferably, during the second period, the multiplexing device establishes following signal transmitting routes: a signal transmitting route between the first primary latching circuit (PRI_LATCH) and the second digital-to-analog converting circuit, a signal transmitting route between the second primary latching circuit (PRI_LATCH) and the first digital-to-analog converting circuit, a signal transmitting route between the third primary latching circuit (PRI_LATCH) and the third digital-to-analog converting circuit, and a signal transmitting route between the fourth primary latching circuit (PRI_LATCH) and the fourth digital-to-analog converting circuit. Besides, the switching device establishes following signal transmitting routes: a signal transmitting route between the first digital-to-analog converting circuit (DAC_CKT) and the second output circuit, a signal transmitting route between the second digital-to-analog converting circuit (DAC_CKT) and the first output circuit, a signal transmitting route between the third digital-to-analog converting circuit (DAC_CKT) and the third output circuit, and a signal transmitting route between the fourth digital-to-analog converting circuit (DAC_CKT) and the fourth output circuit.

Another exemplary embodiment of the present invention provides a source driver, including: N primary latching circuits, a multiplexing device, N digital-to-analog converting circuits, a switching device and N output circuits. The N primary latching circuits (PRI_LATCHs) are utilized for respectively receiving N pixel data. The multiplexing device is coupled to the N primary latching circuits, for controlling signal transmitting routes of the N primary latching circuits. The N digital-to-analog converting circuits (DAC_CKTs) respectively have positive or negative signal outputs, and each digital-to-analog converting circuit (DAC_CKT) having a signal output polarity different from a signal output polarity of an adjacent digital-to-analog converting circuit. The N digital-to-analog converting circuits (DAC_CKTs) respectively generate N driving voltage signals according to the N pixel data. The switching device is coupled to the N digital-to-analog converting circuits, for controlling signal transmitting routes of the N digital-to-analog converting circuits. The N output circuits (OUT_CKTs) are utilized for receiving the N driving voltage signals, and outputting N source driving signals to N pixels, successively. Wherein, the multiplexing device and the switching device alternatively switch polarities of a plurality of specific source driving signals respectively output by a plurality of adjacent output circuits (OUT_CKTs) within the N output circuits (OUT_CKTs) according to a polarity switching signal, respectively. While the polarities of the specific source driving signals are positive, positive, negative and negative during a first period, respectively, and the polarities of the specific source driving signals are negative, negative, positive and positive during a second period, respectively.

Preferably, during the first period, the multiplexing device establishes following signal transmitting routes: a signal transmitting route between a first primary latching circuit (PRI_LATCH) and a first digital-to-analog converting circuit, a signal transmitting route between a second primary latching circuit (PRI_LATCH) and a third digital-to-analog converting circuit, a signal transmitting route between a third primary latching circuit (PRI_LATCH) and a second digital-to-analog converting circuit, and a signal transmitting route between a fourth primary latching circuit (PRI_LATCH) and a fourth digital-to-analog converting circuit. Besides, the switching device establishes following signal transmitting routes: a signal transmitting route between the first digital-to-analog converting circuit (DAC_CKT) and the first output circuit, a signal transmitting route between the second digital-to-analog converting circuit (DAC_CKT) and the third output circuit, a signal transmitting route between the third digital-to-analog converting circuit (DAC_CKT) and the second output circuit, and a signal transmitting route between the fourth digital-to-analog converting circuit (DAC_CKT) and the fourth output circuit. The first primary latching circuit (PRI_LATCH) to the fourth primary latching circuit, the first digital-to-analog converting circuit (DAC_CKT) to the fourth digital-to-analog converting circuit (DAC_CKT) and the first output circuit (OUT_CKT) to the fourth output circuit (OUT_CKT) are respective adjacent to one another, and the first output circuit (OUT_CKT) to the fourth output circuit (OUT_CKT) respectively output the specific source driving signals.

Preferably, during the second period, the multiplexing device establishes following signal transmitting routes: a signal transmitting route between the first primary latching circuit (PRI_LATCH) and the fourth digital-to-analog converting circuit, a signal transmitting route between the second primary latching circuit (PRI_LATCH) and the second digital-to-analog converting circuit, a signal transmitting route between the third primary latching circuit (PRI_LATCH) and the third digital-to-analog converting circuit, and a signal transmitting route between the fourth primary latching circuit (PRI_LATCH) and the first digital-to-analog converting circuit. Besides, the switching device establishes following signal transmitting routes: a signal transmitting route between the first digital-to-analog converting circuit (DAC_CKT) and the fourth output circuit, a signal transmitting route between the second digital-to-analog converting circuit (DAC_CKT) and the second output circuit, a signal transmitting route between the third digital-to-analog converting circuit (DAC_CKT) and the third output circuit, and a signal transmitting route between the fourth digital-to-analog converting circuit (DAC_CKT) and the first output circuit.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
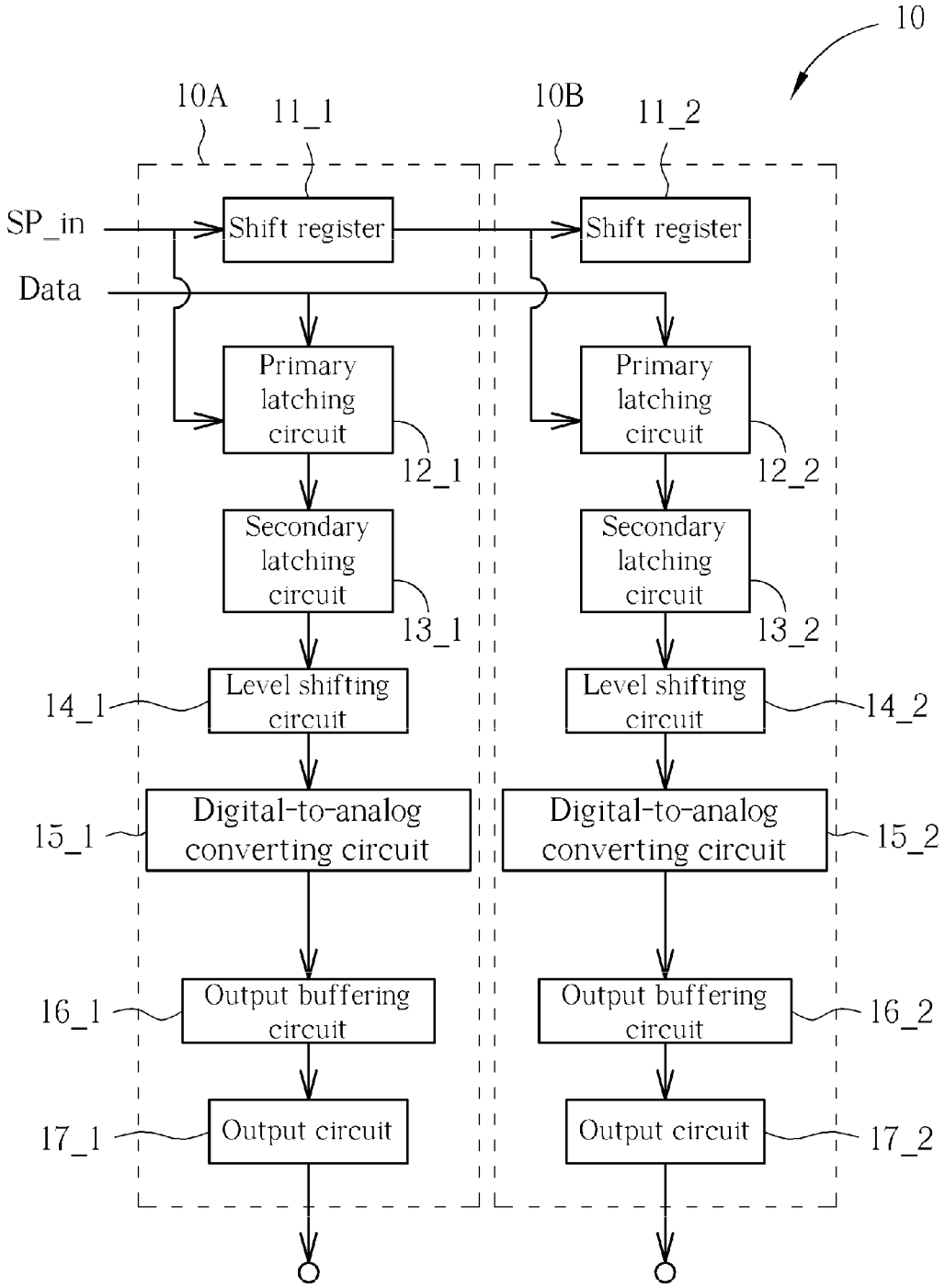
FIG. 1 PRIOR ART
FIG. 1 is a function block diagram of a source driver according to the prior art.
Figure 2:
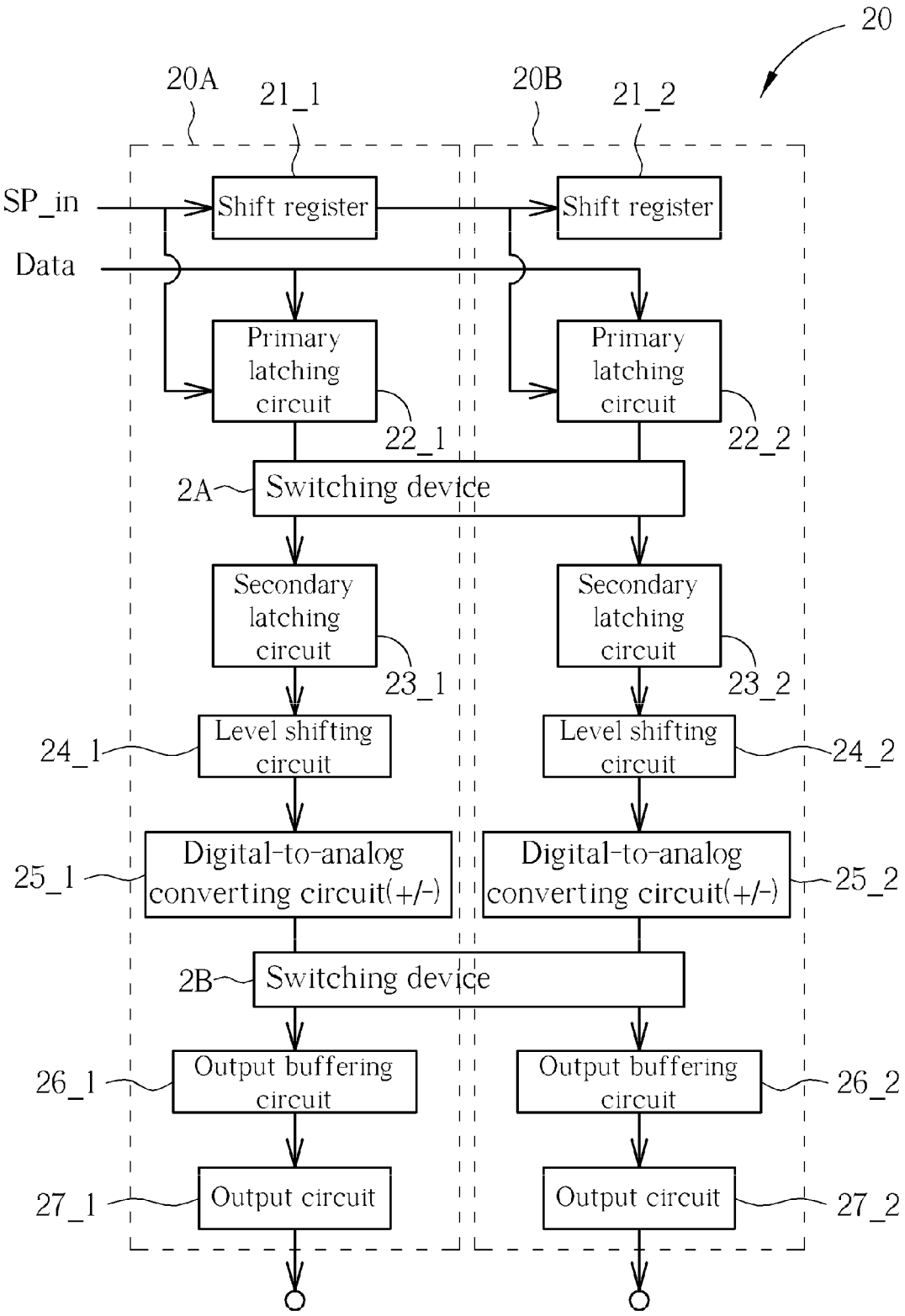
FIG. 2 PRIOR ART
FIG. 2 is a function block diagram of an improved source driver according to the prior art.
Figure 3:
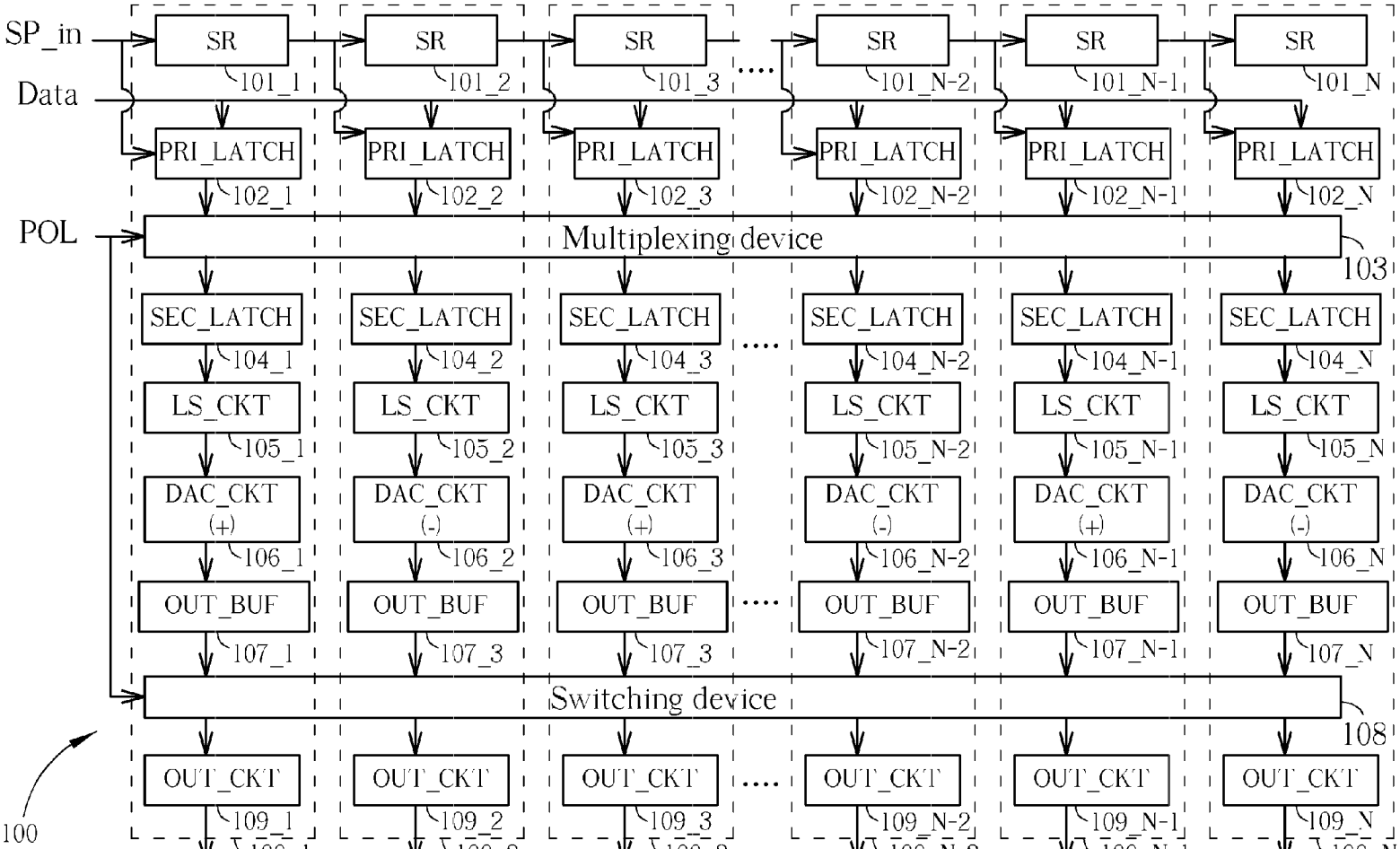
FIG. 3 is a function block diagram illustrating the first exemplary embodiment of a source driver according to the present invention.

Please refer to FIG. 3, which is a function block diagram illustrating the first exemplary embodiment of the source driver according to the present invention. As shown in the figure, the source driver 100 includes, but is not limited to, N shift registers (SRs) 101_1-101_N, N primary latching circuits (PRI_LATCHs) 102_1-102_N, a multiplexing device 103, N secondary latching circuits (SEC_LATCHs) 104_1-104_N, N level shifting circuits (LS_CKTs) 105_1-105_N, N digital-to-analog converting circuits (DAC_CKTs) 106_1-106_N, N output buffer circuits (OUT_BUFs) 107_1-107_N, a switching device 108 and N output circuits (OUT_CKTs) 109_1-109_N. These circuits respectively form signal channels 100_1-100_N and thereby provide N source driving signals to N pixels.

The shift registers (SRs) 101_1-101_N are utilized for controlling N primary latching circuits (PRI_LATCHs) 102_1-102_N to respectively receive N pixel data from an image data (Data) according to a control signal SP_in. The multiplexing device 103 is coupled to the primary latching circuits (PRI_LATCHs) 102_1-102_N, and used for controlling signal transmitting routes of the primary latching circuits (PRI_LATCHs) 102_1-102_N. The secondary latching circuits (SEC_LATCHs) 104_1-104_N are coupled to the multiplexing device 103, and used for receiving the N pixel data. The level shifting circuits (LS_CKTs) 105_1-105_N are respectively coupled to the secondary latching circuits (SEC_LATCHs) 104_1-104_N, and used for performing signal level shifting upon the N pixel data. Moreover, the digital-to-analog converting circuits (DAC_CKTs) 106_1-106_N respectively have positive or negative signal outputs, as shown in the figure; besides, digital-to-analog converting circuits (DAC_CKTs) of adjacent signal channels have different signal output polarities. The digital-to-analog converting circuits (DAC_CKTs) 106_1-106_N respectively generate N driving voltage signals according to the N pixel data. The output buffer circuits (OUT_BUFs) 107_1-107_N are utilized for buffering outputs of the digital-to-analog converting circuits (DAC_CKTs) 106_1-106_N. The switching device 108 is coupled to the output buffer circuits (OUT_BUFs) 107_1-107_N, and used for controlling signal transmitting routes of the output buffer circuits (OUT_BUFs) 107_1-107_N to thereby determine how the N driving voltage signals are fed into the output circuits (OUT_CKTs) 109_1-109_N. The output circuits (OUT_CKTs) 109_1-109_N are utilized for receiving the N driving voltage signals, and outputting N source driving signals to N pixels according to the N received driving voltage signals. The multiplexing device 103 and the switching device 108 alternatively switch polarities of a plurality of specific source driving signals respectively output by a plurality of adjacent output circuits (OUT_CKTs) in the N output circuits (OUT_CKTs) according to a polarity switching signal POL, respectively. The source driver 100 may generate different polarity inversion patterns of the driving signals by different signal transmitting routes established by the multiplexing device 103 and the switching device 108. It should be noted that the aforementioned circuit components are not meant to be a limitation of the present invention. In fact, in an exemplary embodiment, a signal channel may only include a primary latching circuit, a multiplexing device, a digital-to-analog converting circuit, a switching device and an output circuit.

The following will illustrate different signal polarity inversion patterns achieved by the source driver 100 according to exemplary embodiments of the present invention.

Figure 4A:
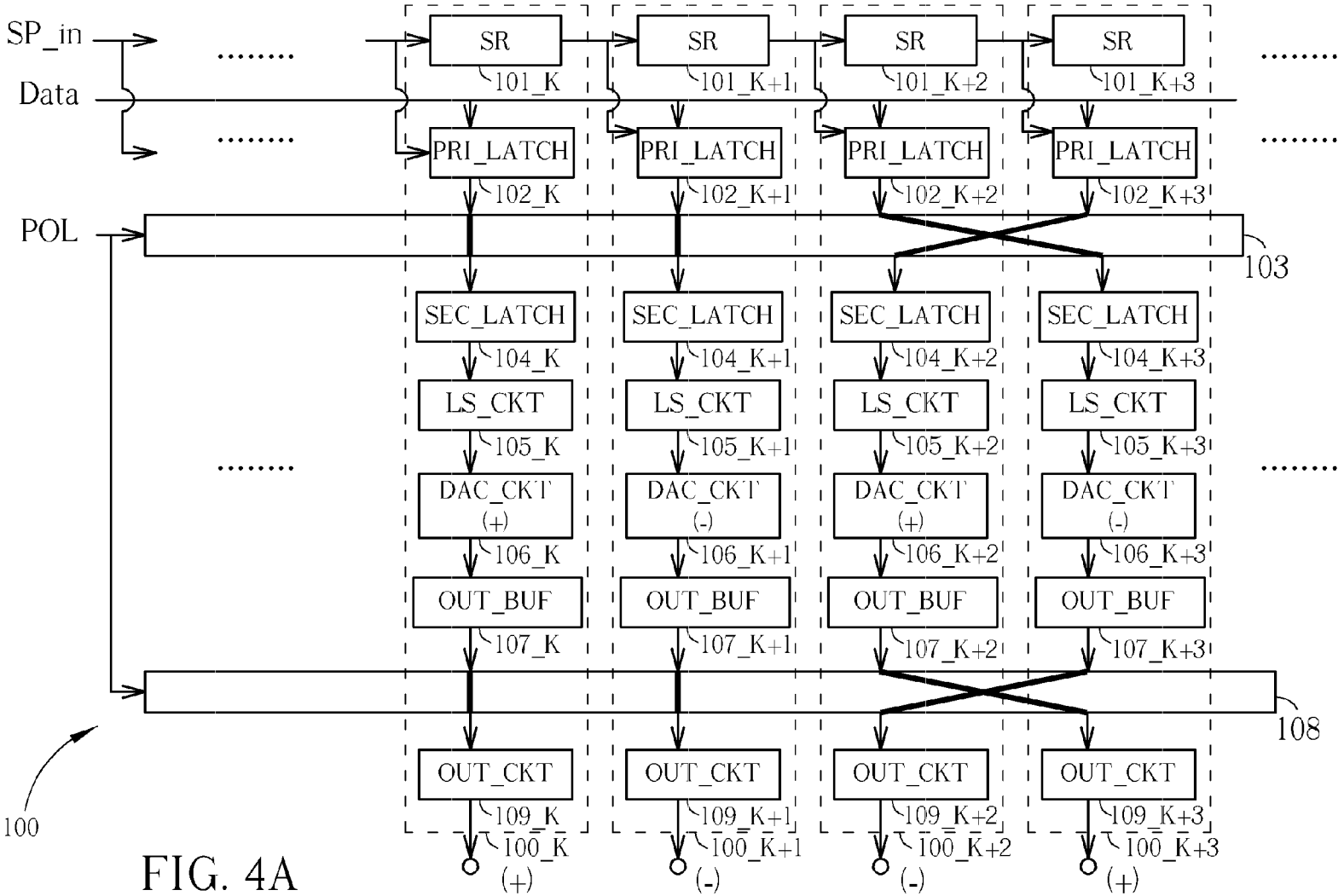
FIG. 4A illustrates a signal polarity inversion pattern achieved by the first exemplary embodiment of the source driver according to the present invention.
Figure 4B:
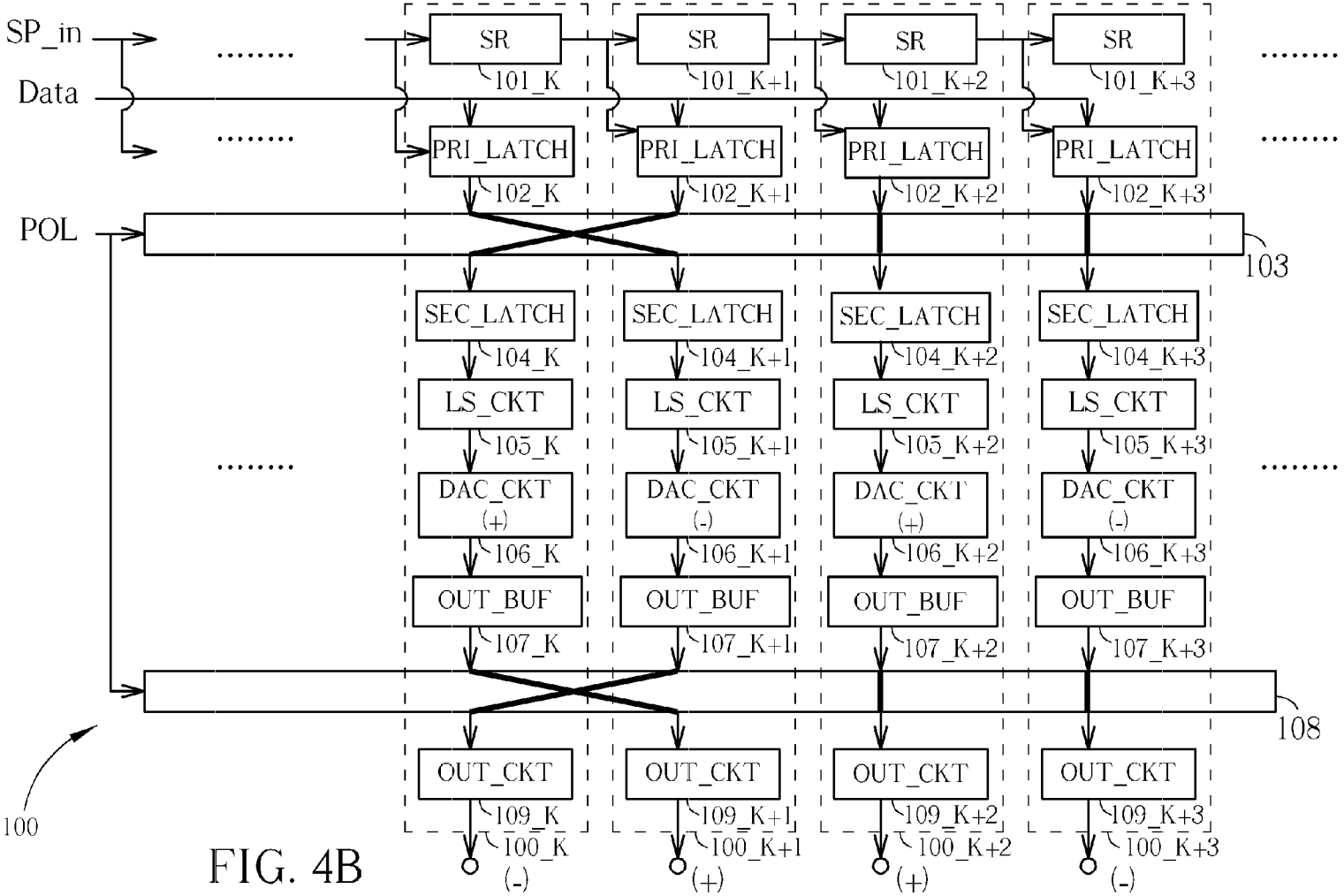
FIG. 4B illustrates a signal polarity inversion pattern achieved by the first exemplary embodiment of the source driver according to the present invention.

First, please refer to FIG. 4A and FIG. 4B. FIG. 4A and FIG. 4B illustrate the signal polarity inversion patterns provided by the source driver 100 and the signal transmitting routes established by the multiplexing device 103 and the switching device 108 before and after inversion provided by the source driver 100 according to an exemplary embodiment of the present invention, respectively. This exemplary embodiment may allow the polarities of source driving signals output by adjacent signal channels 100_$k$-100_$k$+3 (which may be any adjacent four signal channels in the signal channels 100_1-100_N) to be positive, negative, negative and positive respectively during a first period and to be negative, positive, positive and negative respectively during a second period. Here, the first period and the second period correspond to different synchronization signals (may be horizontal synchronization signals Hsync or vertical synchronization signals Vsync), respectively. For example, if the first period and the second period correspond to different horizontal synchronization signals Hsync, the first period and the second period respectively represent different scan line periods. If the first period and the second period correspond to different vertical synchronization signals Vsync, the first period and the second period respectively represent different frame periods. Moreover, it should be noted that the source driving signals output by the adjacent signal channels correspond to adjacent pixels, respectively. In other words, the adjacent signal channels correspond to pixel data of adjacent pixels, but are not required to be disposed at physical locations adjacent to each other in the circuit layout.

The internal wires of the multiplexing device 103 shown in FIG. 4A represent signal transmitting routes established by the multiplexing device 103 during the first period. In addition, the internal wires of the switching device 108 represent signal transmitting routes established by the switching device 108 during the first period. The multiplexing device 103 establishes the following signal transmitting routes: a signal transmitting route between a primary latching circuit (PRI_LATCH) 102_*k* and a digital-to-analog converting circuit (DAC_CKT) 106_*k*, a signal transmitting route between a primary latching circuit (PRI_LATCH) 102_*k*+1 and a digital-to-analog converting circuit (DAC_CKT) 106_*k*+1, a signal transmitting route between a primary latching circuit (PRI_LATCH) 102_*k*+2 and a digital-to-analog converting circuit (DAC_CKT) 106_*k*+3, and a signal transmitting route between a primary latching circuit (PRI_LATCH) 102_*k*+3 and a digital-to-analog converting circuit (DAC_CKT) 106_*k*+2. Moreover, during the same first period, the switching device 108 establishes the following signal transmitting routes: a signal transmitting route between the digital-to-analog converting circuit (DAC_CKT) 106_*k* and the output circuit (OUT_CKT) 109_*k*, a signal transmitting route between the digital-to-analog converting circuit (DAC_CKT) 106_*k*+1 and the output circuit (OUT_CKT) 109_*k*+1, a signal transmitting route between the digital-to-analog converting circuit (DAC_CKT) 106_*k*+2 and the output circuit (OUT_CKT) 109_*k*+3, and a signal transmitting route between the digital-to-analog converting circuit (DAC_CKT) 106_*k*+3 and the output circuit (OUT_CKT) 109_*k*+2.

Moreover, the internal wires of the multiplexing device 103 shown in FIG. 4B represent signal transmitting routes established by the multiplexing device 103 during the second period. In addition, the internal wires of the switching device 108 represent signal transmitting routes established by the switching device 108 during the second period. The multiplexing device 103 establishes the following signal transmitting routes: a signal transmitting route between the primary latching circuit (PRI_LATCH) 102_*k* and the digital-to-analog converting circuit (DAC_CKT) 106_*k*+1, a signal transmitting route between the primary latching circuit (PRI_LATCH) 102_*k*+1 and the digital-to-analog converting circuit (DAC_CKT) 106_*k*, a signal transmitting route between the primary latching circuit (PRI_LATCH) 102_*k*+2 and the digital-to-analog converting circuit (DAC_CKT) 106_*k*+2, and a signal transmitting route between the primary latching circuit (PRI_LATCH) 102_*k*+3 and the digital-to-analog converting circuit (DAC_CKT) 106_*k*+3. Moreover, during the same second period, the switching device 108 establishes the following signal transmitting routes: a signal transmitting route between the digital-to-analog converting circuit (DAC_CKT) 106_*k* and the output circuit (OUT_CKT) 109_*k*+1, a signal transmitting route between the digital-to-analog converting circuit (DAC_CKT) 106_*k*+1 and the output circuit (OUT_CKT) 109_*k*, a signal transmitting route between the digital-to-analog converting circuit (DAC_CKT) 106_*k*+2 and the output circuit (OUT_CKT) 109_*k*+2, and a signal transmitting route between the digital-to-analog converting circuit (DAC_CKT) 106_*k*+3 and the output circuit (OUT_CKT) 109_*k*+3.

By the switching of signal transmitting routes mentioned above, this exemplary embodiment may provide a polarity inversion pattern of switching the polarities of a plurality of specific source driving signals of the N source driving signals from positive (+), negative (−), negative (−) and positive (+) to negative (−), positive (+), positive (+) and negative (−).

Figure 5A:
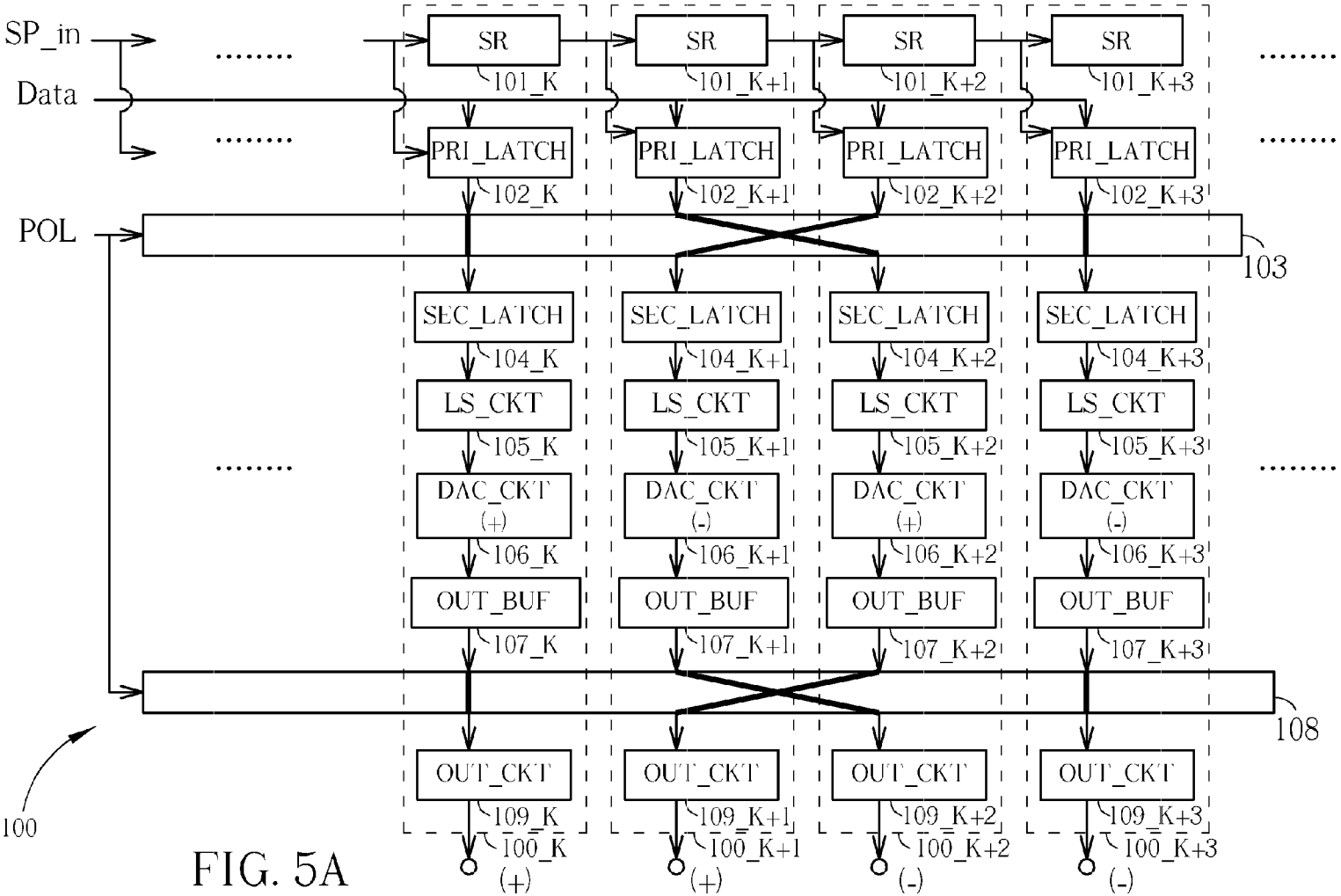
FIG. 5A illustrates a signal polarity inversion pattern achieved by the first exemplary embodiment of the source driver according to the present invention.
Figure 5B:
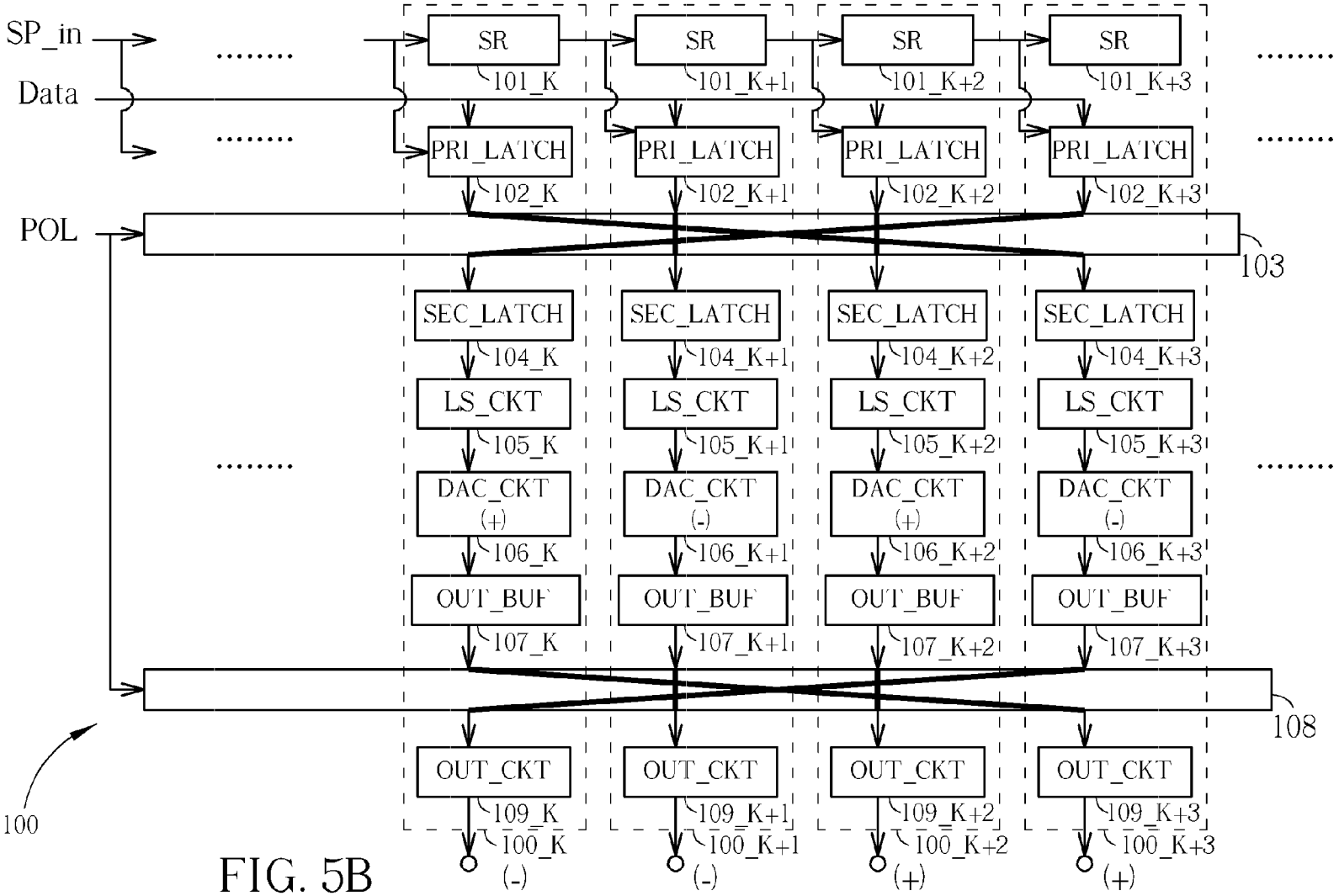
FIG. 5B illustrates a signal polarity inversion pattern achieved by the first exemplary embodiment of the source driver according to the present invention.

Next, please refer to FIG. 5A and FIG. 5B. FIG. 5A and FIG. 5B illustrate a signal polarity inversion pattern provided by the source driver 100 and detailed operation according to another exemplary embodiment of the present invention, respectively. This exemplary embodiment may make the polarities of source driving signals output by adjacent signal channels 100_*k*-100_*k*+3 to be positive, positive, negative and negative respectively during a first period and to be negative, negative, positive and positive respectively during a second period. Here, the first period and the second period respectively correspond to different synchronization signals (which may be horizontal synchronization signals Hsync or vertical synchronization signals Vsync). For example, if the first period and the second period correspond to different horizontal synchronization signals Hsync, the first period and the second period represent different scan line periods, respectively. If the first period and the second period correspond to different vertical synchronization signals Vsync, the first period and the second period represent different frame periods, respectively. Moreover, it should be noted that the source driving signals output by the adjacent signal channels correspond to adjacent pixels, respectively. In other words, the adjacent signal channels correspond to pixel data of adjacent pixels, but are not required to be disposed at physical locations adjacent to each other in the circuit layout.

Please refer to FIG. 5A. During the first period, the multiplexing device 103 establishes the following signal transmitting routes: a signal transmitting route between the primary latching circuit (PRI_LATCH) 102_*k* and the digital-to-analog converting circuit (DAC_CKT) 106_*k*, a signal transmitting route between the primary latching circuit (PRI_LATCH) 102_*k*+1 and the digital-to-analog converting circuit (DAC_CKT) 106_*k*+2, a signal transmitting route between the primary latching circuit (PRI_LATCH) 102_*k*+2 and the digital-to-analog converting circuit (DAC_CKT) 106_*k*+1, and a signal transmitting route between the primary latching circuit (PRI_LATCH) 102_*k*+3 and the digital-to-analog converting circuit (DAC_CKT) 106_*k*+3. Moreover, during the same first period, the switching device 108 establishes the following signal transmitting routes: a signal transmitting route between the digital-to-analog converting circuit (DAC_CKT) 106_*k* and the output circuit (OUT_CKT) 109_*k*, a signal transmitting route between the digital-to-analog converting circuit (DAC_CKT) 106_*k*+1 and the output circuit (OUT_CKT) 109_*k*+2, a signal transmitting route between the digital-to-analog converting circuit (DAC_CKT) 106_*k*+2 and the output circuit (OUT_CKT) 109_*k*+1, and a signal transmitting route between the digital-to-analog converting circuit (DAC_CKT) 106_*k*+3 and the output circuit (OUT_CKT) 109_*k*+3.

Moreover, in FIG. 5B, during the second period, the multiplexing device 103 establishes the following signal transmitting routes: a signal transmitting route between the primary latching circuit (PRI_LATCH) 102_*k* and the digital-to-analog converting circuit (DAC_CKT) 106_*k*+3, a signal transmitting route between the primary latching circuit (PRI_LATCH) 102_*k*+1 and the digital-to-analog converting circuit (DAC_CKT) 106_*k*+1, a signal transmitting route between the primary latching circuit (PRI_LATCH) 102_*k*+2 and the digital-to-analog converting circuit (DAC_CKT) 106_*k*+2, and a signal transmitting route between the primary latching circuit (PRI_LATCH) 102_

$k$+3 and the digital-to-analog converting circuit (DAC_CKT) 106_$k$. Moreover, during the same second period, the switching device 108 establishes the following signal transmitting routes: a signal transmitting route between the digital-to-analog converting circuit (DAC_CKT) 106_$k$ and the output circuit (OUT_CKT) 109_$k$+3, a signal transmitting route between the digital-to-analog converting circuit (DAC_CKT) 106_$k$+1 and the output circuit (OUT_CKT) 109_$k$+1, a signal transmitting route between the digital-to-analog converting circuit (DAC_CKT) 106_$k$+2 and the output circuit (OUT_CKT) 109_$k$+2, and a signal transmitting route between the digital-to-analog converting circuit (DAC_CKT) 106_$k$+3 and the output circuit (OUT_CKT) 109_$k$.

In addition to two signal polarity inversion patterns mentioned above, the source driver 100 of the present invention may provide a traditional dot inversion pattern. Please refer to FIG. 6A and FIG. 6B for detailed operation. During a first period, the polarities of source driving signals output by adjacent signal channels 100_$k$-100_$k$+3 are positive, negative, positive and negative, respectively, and during a second period, the polarities of source driving signals output by adjacent signal channels 100_$k$-100_$k$+3 are negative, positive, negative and positive, respectively.

Figure 6A:
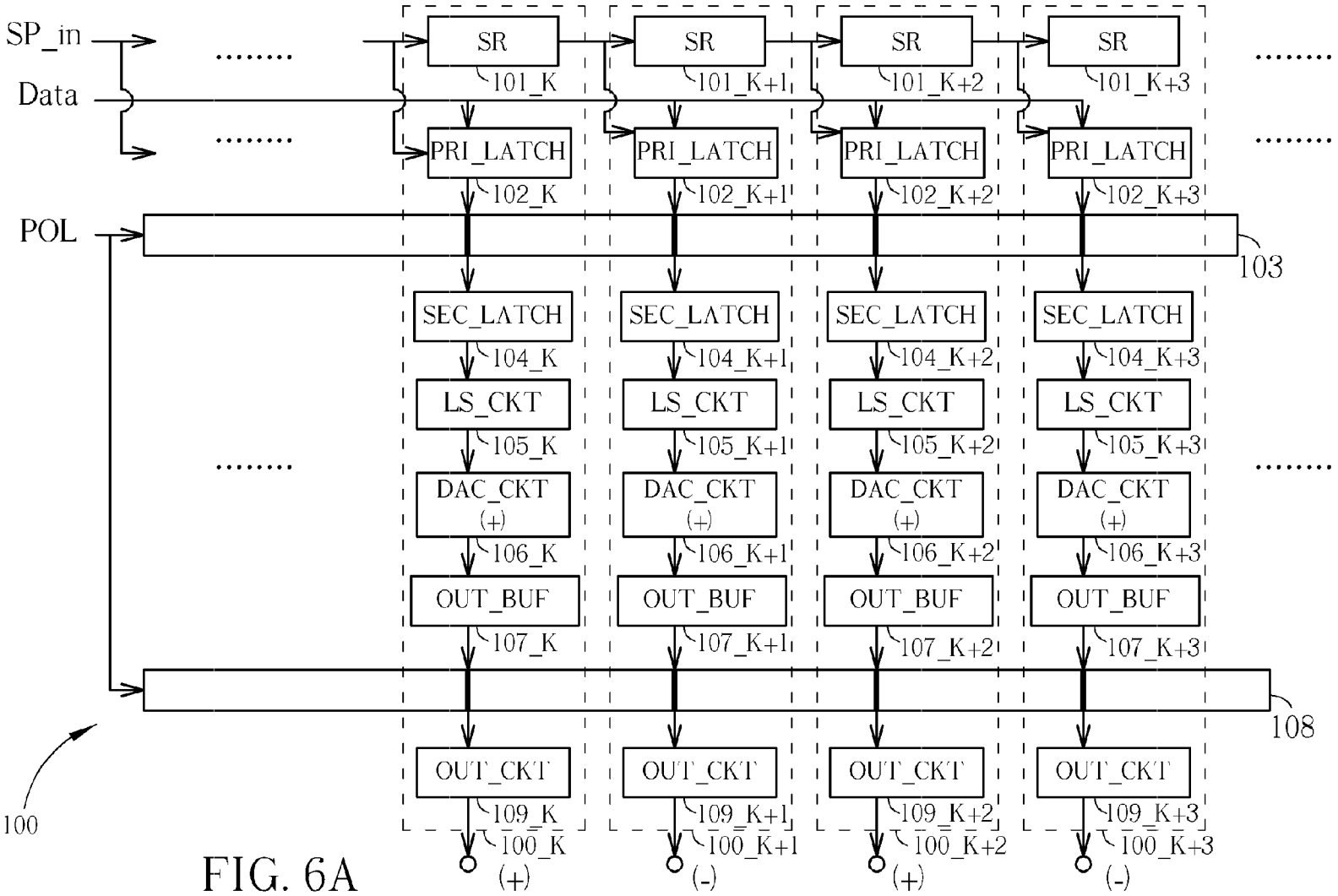
FIG. 6A illustrates a signal polarity inversion pattern achieved by the first exemplary embodiment of the source driver according to the present invention.

Next, please refer to FIG. 6A. During the first period, the multiplexing device 103 establishes the following signal transmitting routes: a signal transmitting route between the primary latching circuit (PRI_LATCH) 102_$k$ and the digital-to-analog converting circuit (DAC_CKT) 106_$k$, a signal transmitting route between the primary latching circuit (PRI_LATCH) 102_$k$+1 and the digital-to-analog converting circuit (DAC_CKT) 106_$k$+1, a signal transmitting route between the primary latching circuit (PRI_LATCH) 102_$k$+2 and the digital-to-analog converting circuit (DAC_CKT) 106_$k$+2, and a signal transmitting route between the primary latching circuit (PRI_LATCH) 102_$k$+3 and the digital-to-analog converting circuit (DAC_CKT) 106_$k$+3. Moreover, during the same first period, the switching device 108 establishes the following signal transmitting routes: a signal transmitting route between the digital-to-analog converting circuit (DAC_CKT) 106_$k$ and the output circuit (OUT_CKT) 109_$k$, a signal transmitting route between the digital-to-analog converting circuit (DAC_CKT) 106_$k$+1 and the output circuit (OUT_CKT) 109_$k$+1, a signal transmitting route between the digital-to-analog converting circuit (DAC_CKT) 106_$k$+2 and the output circuit (OUT_CKT) 109_$k$+2, and a signal transmitting route between the digital-to-analog converting circuit (DAC_CKT) 106_$k$+3 and the output circuit (OUT_CKT) 109_$k$+3.

Figure 6B:
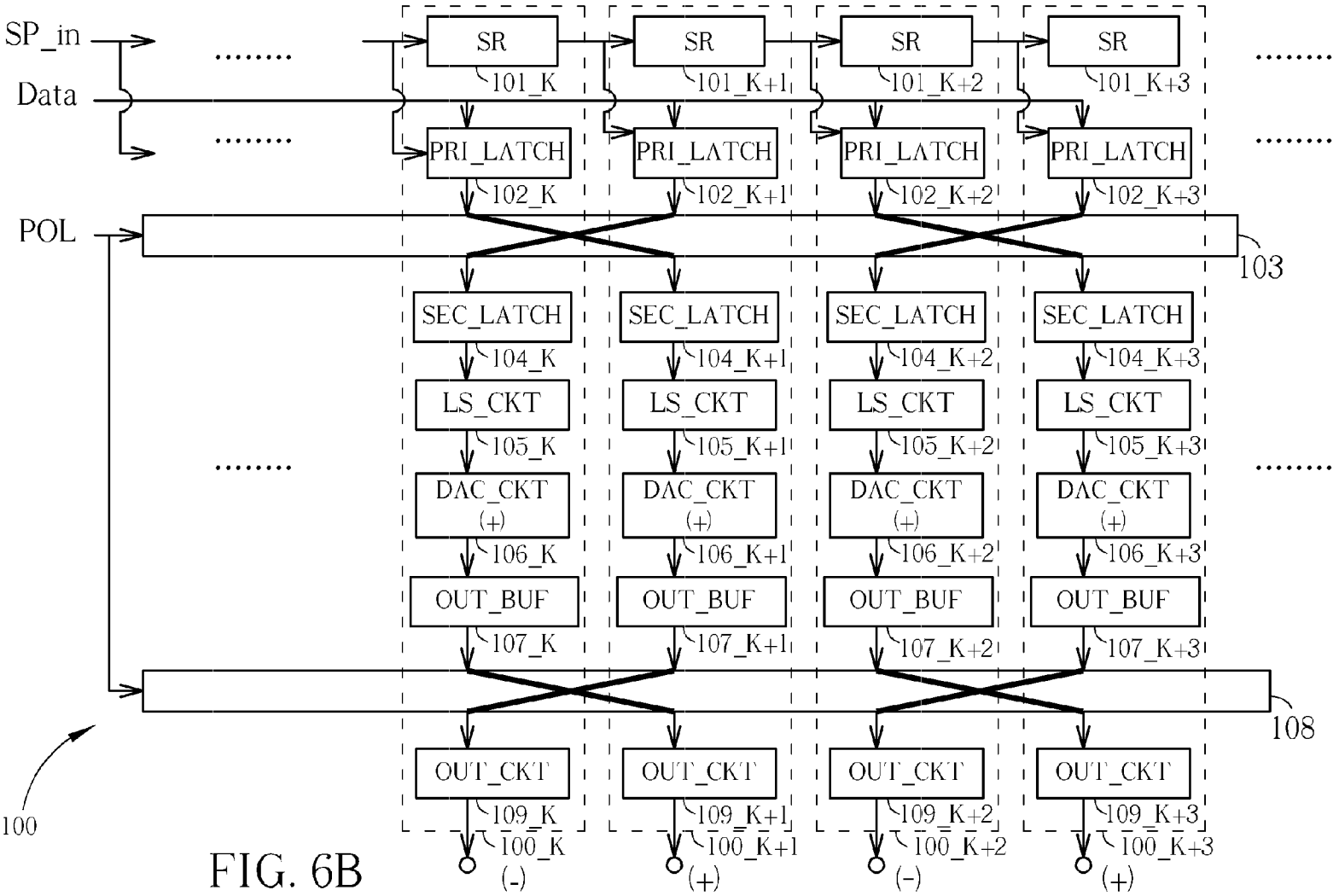
FIG. 6B illustrates a signal polarity inversion pattern achieved by the first exemplary embodiment of the source driver according to the present invention.

As shown in FIG. 6B, during the second period, the multiplexing device 103 establishes the following signal transmitting routes: a signal transmitting route between the primary latching circuit (PRI_LATCH) 102_$k$ and the digital-to-analog converting circuit (DAC_CKT) 106_$k$+1, a signal transmitting route between the primary latching circuit (PRI_LATCH) 102_$k$+1 and the digital-to-analog converting circuit (DAC_CKT) 106_$k$, a signal transmitting route between the primary latching circuit (PRI_LATCH) 102_$k$+2 and the digital-to-analog converting circuit (DAC_CKT) 106_$k$+3, and a signal transmitting route between the primary latching circuit (PRI_LATCH) 102_$k$+3 and the digital-to-analog converting circuit (DAC_CKT) 106_$k$+2. Moreover, during the same second period, the switching device 108 establishes the following signal transmitting routes: a signal transmitting route between the digital-to-analog converting circuit (DAC_CKT) 106_$k$ and the output circuit (OUT_CKT) 109_$k$+1, a signal transmitting route between the digital-to-analog converting circuit (DAC_CKT) 106_$k$+1 and the output circuit (OUT_CKT) 109_$k$, a signal transmitting route between the digital-to-analog converting circuit (DAC_CKT) 106_$k$+2 and the output circuit (OUT_CKT) 109_$k$+3, and a signal transmitting route between the digital-to-analog converting circuit (DAC_CKT) 106_$k$+3 and the output circuit (OUT_CKT) 109_$k$+2.

It should be noted that in a reasonable scope of the present invention, the three polarity inversion patterns disclosed above may be definitely realized in one specific exemplary embodiment of the present invention. This is because the signal transmitting routes established by the multiplexing device 103 and the switching device 108 of the present invention are quite flexible, thus allowing the signal transmitting routes of different signal transmitting channels to be switched freely. Moreover, in contrast to the prior art, the multiplexing device 103 and the switching device 108 of the present invention may further establish signal transmitting routes between signal channels that are not adjacent to one another (e.g., a signal transmitting route between the primary latching circuit (PRI_LATCH) 102_$k$ and the digital-to-analog converting circuit (DAC_CKT) 106_$k$+3 or a signal transmitting route between the digital-to-analog converting circuit (DAC_CKT) 106_$k$+3 and the output circuit (OUT_CKT) 109_$k$, as shown in FIG. 5A and FIG. 5B).

Briefly summarized, the present invention may effectively establish signal transmitting routes for source drivers having different structures (e.g., the first exemplary embodiment) by utilizing a multiplexing device and a switching device to provide a variety of signal polarity inversion patterns.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A source driver, comprising:

N primary latching circuits, for respectively receiving N pixel data, wherein N is a positive integer;

a multiplexing device, coupled to the N primary latching circuits, for controlling signal transmitting routes of the N primary latching circuits;

N digital-to-analog converting circuits, respectively having positive or negative signal outputs, each digital-to-analog converting circuit having a signal output polarity different from a signal output polarity of an adjacent digital-to-analog converting circuit, the N digital-to-analog converting circuits respectively generating N driving voltage signals according to the N pixel data;

a switching device, coupled to the N digital-to-analog converting circuits, for controlling signal transmitting routes of the N digital-to-analog converting circuits; and N output circuits, for receiving the N driving voltage signals, and outputting N source driving signals to N pixels, successively;

wherein the multiplexing device and the switching device alternatively switch polarities of a plurality of specific source driving signals respectively output by a plurality of adjacent output circuits within the N output circuits according to a polarity switching signal, respectively, where:

the polarities of the specific source driving signals are positive, negative, negative and positive during a first period, respectively; and the polarities of the specific source driving signals are negative, positive, positive and negative during a second period, respectively;

wherein during the first period, the multiplexing device and the switching device establish following signal transmitting routes:

the multiplexing device establishing following signal transmitting routes:

a signal transmitting route between a first primary latching circuit and a first digital-to-analog converting circuit, a signal transmitting route between a second primary latching circuit and a second digital-to-analog converting circuit, a signal transmitting route between a third primary latching circuit and a fourth digital-to-analog converting circuit, and a signal transmitting route between a fourth primary latching circuit and a third digital-to-analog converting circuit; and the switching device establishing following signal transmitting routes:

a signal transmitting route between the first digital-to-analog converting circuit and the first output circuit, a signal transmitting route between the second digital-to-analog converting circuit and the second output circuit, a signal transmitting route between the third digital-to-analog converting circuit and the fourth output circuit, and a signal transmitting route between the fourth digital-to-analog converting circuit and the third output circuit;

wherein the first primary latching circuit to the fourth primary latching circuit, the first digital-to-analog converting circuit to the fourth digital-to-analog converting circuit and the first output circuit to the fourth output circuit are respective adjacent to one another, and the first output circuit to the fourth output circuit respectively output the specific source driving signals; and wherein during the second period:

the multiplexing device establishes following signal transmitting routes:

a signal transmitting route between the first primary latching circuit and the second digital-to-analog converting circuit, a signal transmitting route between the second primary latching circuit and the first digital-to-analog converting circuit, a signal transmitting route between the third primary latching circuit and the third digital-to-analog converting circuit, and a signal transmitting route between the fourth primary latching circuit and the fourth digital-to-analog converting circuit; and the switching device establishes following signal transmitting routes:

a signal transmitting route between the first digital-to-analog converting circuit and the second output circuit, a signal transmitting route between the second digital-to-analog converting circuit and the first output circuit, a signal transmitting route between the third digital-to-analog converting circuit and the third output circuit, and a signal transmitting route between the fourth digital-to-analog converting circuit and the fourth output circuit.

2. The source driver of claim 1, further comprising:

N shift registers, respectively coupled to the N primary latching circuits, for controlling the N primary latching circuits to receive the N pixel data according to an image data;

N secondary latching circuits, respectively coupled to the multiplexing device;

N level shifting circuits, respectively coupled between the N primary latching circuits and the N digital-to-analog converting circuits; and N output buffers, respectively coupled between the N digital-to-analog converting circuits and the N output circuits.

3. A source driver, comprising:

N primary latching circuits, for respectively receiving N pixel data, wherein N is a positive integer;

a multiplexing device, coupled to the N primary latching circuits, for controlling signal transmitting routes of the N primary latching circuits;

N digital-to-analog converting circuits, respectively having positive or negative signal outputs, each digital-to-analog converting circuit having a signal output polarity different from a signal output polarity of an adjacent digital-to-analog converting circuit, the N digital-to-analog converting circuits respectively generating N driving voltage signals according to the N pixel data;

a switching device, coupled to the N digital-to-analog converting circuits, for controlling signal transmitting routes of the N digital-to-analog converting circuits; and N output circuits, for receiving the N driving voltage signals, and outputting N source driving signals to N pixels, successively;

wherein the multiplexing device and the switching device alternatively switch polarities of a plurality of specific source driving signals respectively output by a plurality of adjacent output circuits within the N output circuits according to a polarity switching signal, respectively, where:

the polarities of the specific source driving signals are positive, positive, negative and negative during a first period, respectively; and the polarities of the specific source driving signals are negative, negative, positive and positive during a second period, respectively;

wherein during the first period:

the multiplexing device establishes following signal transmitting routes:

a signal transmitting route between a first primary latching circuit and a first digital-to-analog converting circuit, a signal transmitting route between a second primary latching circuit and a third digital-to-analog converting circuit, a signal transmitting route between a third primary latching circuit and a second digital-to-analog converting circuit, and a signal transmitting route between a fourth primary latching circuit and a fourth digital-to-analog converting circuit; and the switching device establishes following signal transmitting routes:

a signal transmitting route between the first digital-to-analog converting circuit and the first output circuit, a signal transmitting route between the second digital-to-analog converting circuit and the third output circuit, a signal transmitting route between the third digital-to-analog converting circuit and the second output circuit, and a signal transmitting route between the fourth digital-to-analog converting circuit and the fourth output circuit;

wherein the first primary latching circuit to the fourth primary latching circuit, the first digital-to-analog converting circuit to the fourth digital-to-analog converting circuit and the first output circuit to the fourth output circuit are respective adjacent to one another, and the first output circuit to the fourth output circuit respectively output the specific source driving signals; and wherein during the second period:

the multiplexing device establishes following signal transmitting routes:

a signal transmitting route between the first primary latching circuit and the fourth digital-to-analog converting circuit, a signal transmitting route between the second primary latching circuit and the second digital-to-analog converting circuit, a signal transmitting route between the third primary latching circuit and the third digital-to-analog converting circuit, and a signal transmitting route between the fourth primary latching circuit and the first digital-to-analog converting circuit; and the switching device establishes following signal transmitting routes:

a signal transmitting route between the first digital-to-analog converting circuit and the fourth output circuit, a signal transmitting route between the second digital-to-analog converting circuit and the second output circuit, a signal transmitting route between the third digital-to-analog converting circuit and the third output circuit, and a signal transmitting route between the fourth digital-to-analog converting circuit and the first output circuit.

4. The source driver of claim 1, further comprising:

N shift registers, respectively coupled to the N primary latching circuits, and controlling the N primary latching circuits to receive the N pixel data according to an image data;

N secondary latching circuits, respectively coupled to the multiplexing device;

N level shifting circuits, respectively coupled between the N secondary latching circuits and the N digital-to-analog converting circuits; and N output buffers, respectively coupled between the N digital-to-analog converting circuits and the N output circuits.

* * * * *